US008833103B2

(12) United States Patent
Baik

(10) Patent No.: US 8,833,103 B2
(45) Date of Patent: Sep. 16, 2014

(54) HOOP EARRING LOCKER

(76) Inventor: Kyung Hak Baik, New York, NY (US)

( * ) Notice: Subject to any disclaimer, the term of this patent is extended or adjusted under 35 U.S.C. 154(b) by 0 days.

(21) Appl. No.: 13/543,136

(22) Filed: Jul. 6, 2012

(65) Prior Publication Data

US 2013/0319044 A1 Dec. 5, 2013

(30) Foreign Application Priority Data

Jun. 4, 2012 (KR) ..... 20-2012-0004685 U

(51) Int. Cl.
*A44C 7/00* (2006.01)

(52) U.S. Cl.
CPC ..... *A44C 7/00* (2013.01)
USPC ..... 63/12; 24/574.1; 24/648

(58) Field of Classification Search
USPC ..... 63/12, 20; 24/574.1, 648, 595.1, 657, 24/608, 611, 615, 625, 618, 634, 637, 641, 24/644, 646, 647, DIG. 51, 633, 636, 24/573.11, 591.1, 596.1, 649, 662, 663, 24/664, 598.5, 601.5, 666; 292/DIG. 29, 292/11, 14, 17, 18, 24, 31, 44, 54, 70, 76, 292/78, 116, 120, 121, 128, 101, 107, 108, 292/213, 218, 219, 228, 202, 209, 210, 303, 292/304, 341.15, 341.17, DIG. 63
See application file for complete search history.

(56) References Cited

U.S. PATENT DOCUMENTS 322,513 A * 7/1885 Williamson ..... 292/18
336,714 A * 2/1886 Harrington ..... 292/128
394,685 A * 12/1888 Fether ..... 292/210
540,801 A * 6/1895 Payne ..... 24/648
1,209,369 A * 12/1916 Wood ..... 24/648
1,397,237 A * 11/1921 Schenk ..... 24/648
2,234,853 A * 3/1941 Brueggeman ..... 24/598.5
3,208,239 A * 9/1965 Pintarelli ..... 63/12
3,789,467 A * 2/1974 Aratani et al. ..... 24/648
3,956,804 A * 5/1976 Gatof et al. ..... 24/598.5
4,003,217 A * 1/1977 Evans et al. ..... 63/12
4,372,131 A * 2/1983 Musillo ..... 63/12
4,578,844 A * 4/1986 Gelula ..... 24/631
4,711,003 A * 12/1987 Gelula ..... 24/631
4,924,562 A * 5/1990 Pogharian ..... 24/647
D339,310 S * 9/1993 Azrielant ..... D11/40
D393,812 S * 4/1998 Silveri ..... D11/40
5,761,928 A * 6/1998 Silveri ..... 63/12
6,508,080 B1 * 1/2003 Ninomiya ..... 63/3.1
6,581,244 B1 * 6/2003 Peters ..... 16/386
7,121,118 B2 * 10/2006 David ..... 63/13
7,128,751 B2 * 10/2006 Reil ..... 606/188
7,878,024 B2 * 2/2011 Baik ..... 63/12

* cited by examiner

*Primary Examiner* — Victor Batson
*Assistant Examiner* — Abigail Morrell
(74) *Attorney, Agent, or Firm* — Sofer & Haroun, LLP

(57) ABSTRACT

Earring having a body, a pin provided at one end of the body and formed with a locking groove, an accessory body provided at the other end to be locked with the locking groove, a handle and a spring. The spring is to be mounted in the lower portion of the accessory body, and the handle is configured to be fitted within the accessory body such that the spring presses at a first end against the inside of the handle and at a second end against the inside of the accessory body. The accessory body maintains an opening for receiving the pin and is formed with an insert groove within the opening into which the pin is inserted, which is elastically locked with the locking groove of the pin by a spring. When the handle is pressed the upper portion of the accessory body opens and the pin is released.

3 Claims, 5 Drawing Sheets

HOOP EARRING LOCKER

RELATED APPLICATION

This application claims the benefit of priority from Korean Patent Application No. 20-2012-0004685 filed on Jun. 4, 2012, the entirety of which is incorporated by reference.

BACKGROUND OF THE INVENTION

1. Field of the Invention

The present invention relates to an earring. More particularly, the present invention relates to an earring capable of easily performing the locking/unlocking operation of coupling parts and improving an aesthetic appearance of the earring.

2. Description of the Related Art

In general, accessories are classified into necklaces, bracelets, anklets, and earrings, which are wound on necks, arms, and legs of a human body or worn on ears in order to exhibit individual preferences or characters in combination with dresses. The accessory is diversely designed according to the user's taste and preference and is on sale in the market.

This accessory is manufactured by connecting various types of jewels to each other using one wire.

This accessory is provided at a final coupling point thereof with coupling parts, and the user can wear the accessory on the user's body by coupling the coupling parts to each other. Especially, since the coupling parts of an earring are inserted into earlobes, which are the weakest parts of the body, the coupling parts should be manufactured precisely and the coupling/decoupling operation thereof must be facilitated.

However, the coupling/decoupling operation of the conventional earring is very difficult and the coupling parts are excessively exposed to the exterior, so that an aesthetic appearance of the earring may be deteriorated.

SUMMARY OF THE INVENTION

Accordingly, the present arrangement solves the above-mentioned problems occurring in the prior art by providing an earring capable of easily performing the locking/unlocking operation of coupling parts and improving an aesthetic appearance of the earring.

In order to accomplish the above object, according to one aspect of the present invention, there is provided an earring having an earring body; an earring pin provided at one end of the earring body and formed with a locking groove; an accessory body provided at the other end of the earring body to be locked with the locking groove, a handle; and a spring. The spring is configured to be mounted in the lower portion of the accessory body and the handle is configured to be fitted within the accessory body such that the spring presses at a first end against an inside surface of said handle and at a second end against an inside surface of the accessory body. The accessory body maintains an opening for receiving the earring pin and the accessory body is formed with an insert groove within the opening into which the earring pin is inserted, which is elastically locked with the locking groove of the earring pin by a spring. When the handle is pressed the upper portion of the accessory body opens and the earring pin is released.

As mentioned above, the earring according to the present invention can easily perform the locking/unlocking operation of coupling parts and improve an aesthetic appearance of the earring.

BRIEF DESCRIPTION OF THE DRAWINGS

The above and other objects, features and other advantages of the present invention will be more dearly understood from the following detailed description taken in conjunction with the accompanying drawings, in which.

DETAILED DESCRIPTION OF THE PREFERRED EMBODIMENT

Hereinafter, preferred embodiments of the present invention will be described in detail with reference to the accompanying drawings.

Figure 1:
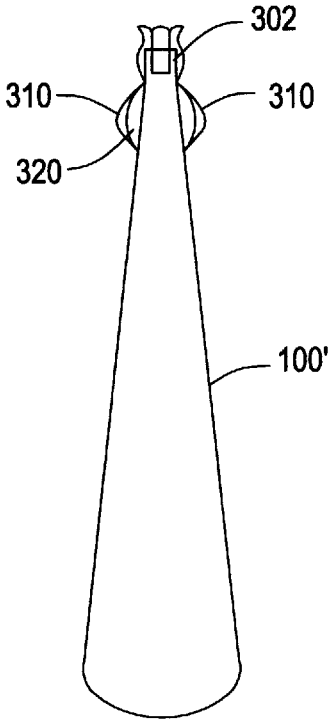
FIG. 1 is a front view showing an earring according to an exemplary embodiment of the present invention.
Figure 2:
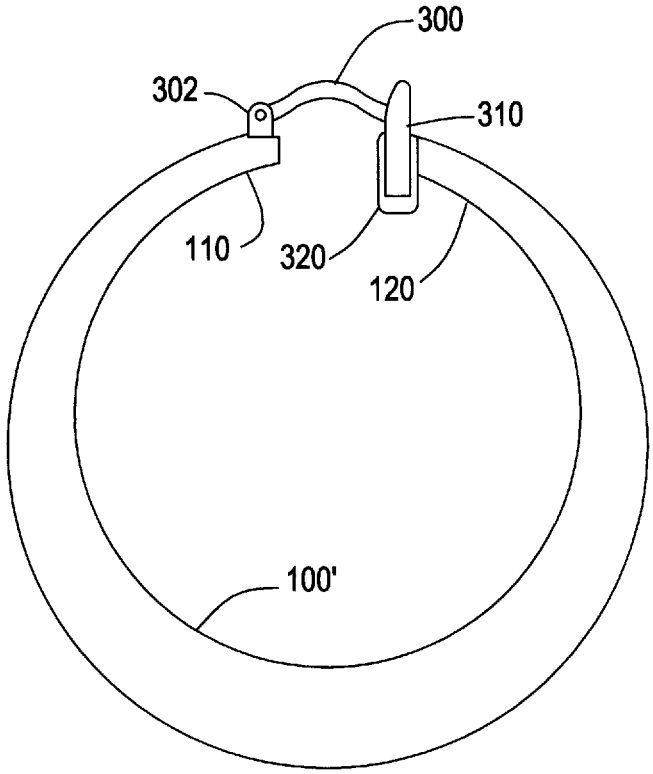
FIG. 2 is a side view showing an earring according to an exemplary embodiment of the present invention.
Figure 3:
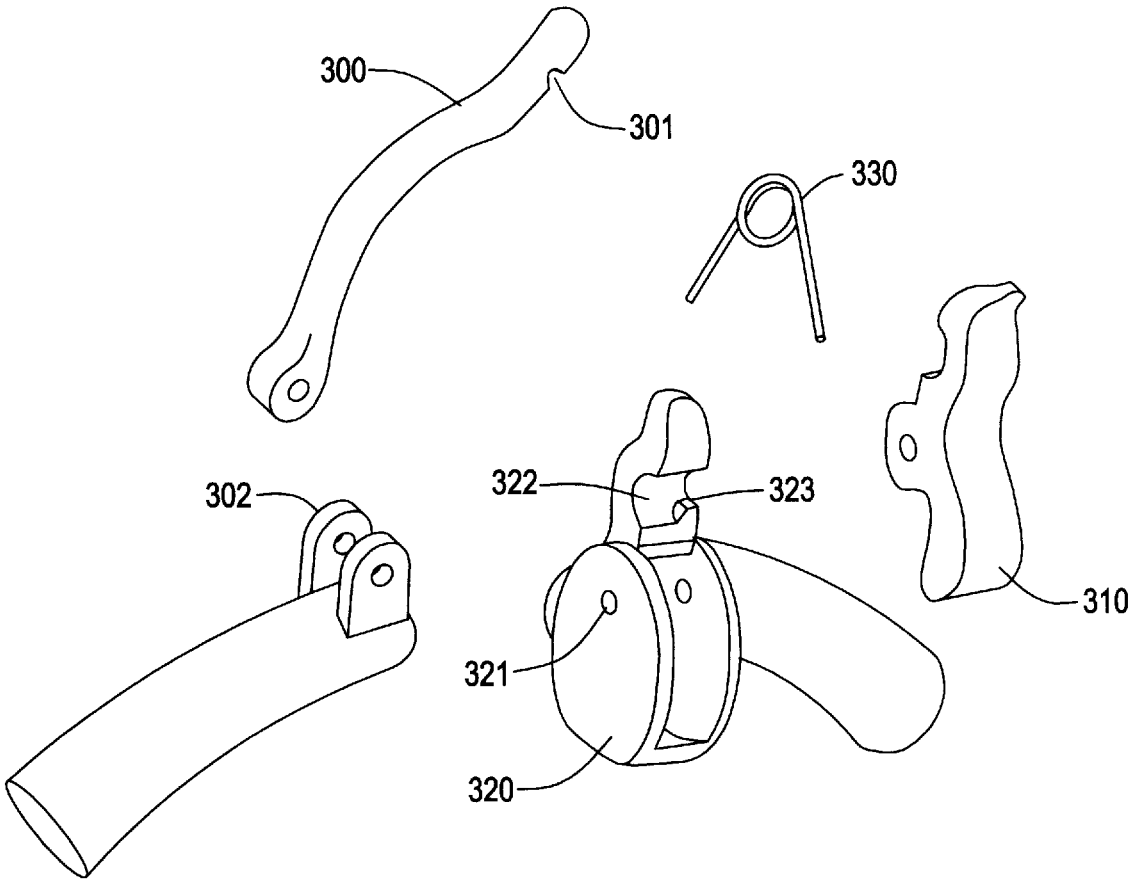
FIG. 3 shows the components of the locking mechanism of the earring according to an exemplary embodiment of the present invention.

As shown in FIGS. 1 to 3, the earring 100 according to an exemplary embodiment of the present invention includes coupling parts 110 and 120, which are provided at both ends of an earring body 100, respectively.

In detail, the earring body 100 is provided at one end 110 with an earring pin 300 having a locking groove 301. Earring pin 300 is connected to coupling part 110 via hinge 302. In addition, earring body 100 is also provided at the other end 120 with an accessory body 320. The earring pin 300 and the accessory body 320 are formed at both distal ends of the earring body 100 while facing each other, respectively. When earring pin 300 is pushed into accessory body 320, coupling parts 110 and 120 of earring body 100 are connected.

Accessory body 320 is formed with an insert groove 323, into which locking groove 301 of earring pin 300 can be inserted. The protrusion 323 is provided at the inside thereof which is elastically locked with the locking groove 301 of the earring pin 300 by a spring 330. The spring 330 is preferably constructed as a tortional spring.

Figure 5A:
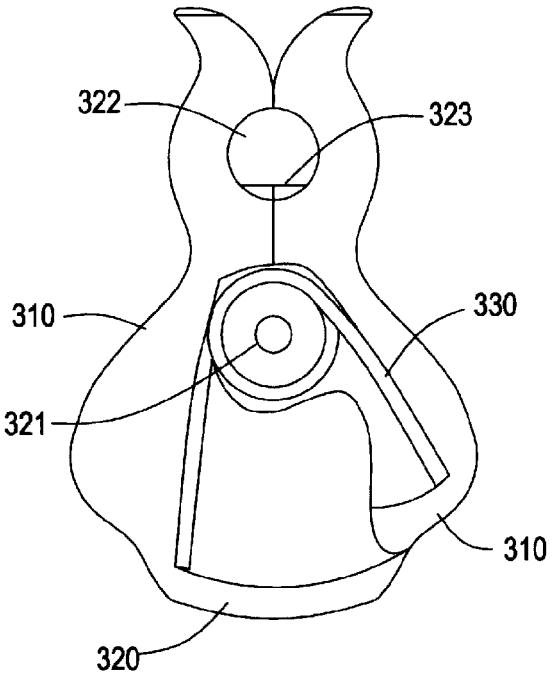
FIGS. 5*a* and 5*b* show the accessory body in an open and closed configuration according to another exemplary embodiment of the present invention.
Figure 5B:
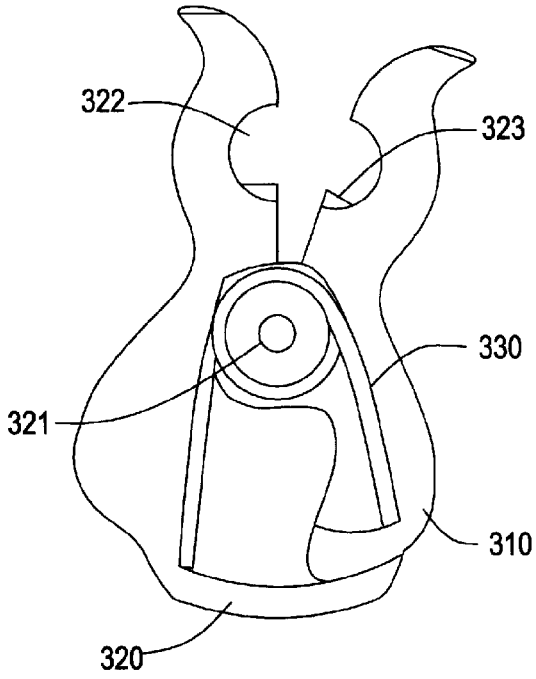
Figure 6A:
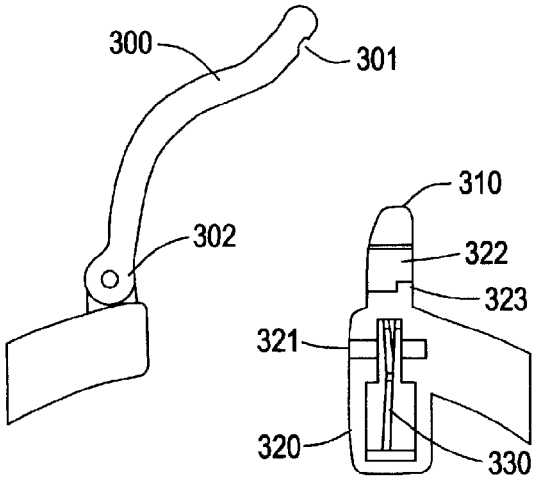
FIGS. 6*a* and 6*b* show the earring pin in an open and closed configuration according to one embodiment of the invention.
Figure 6B:
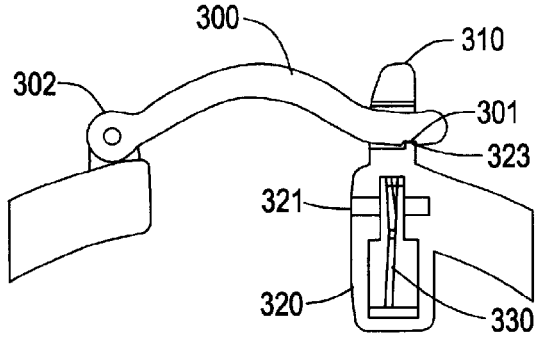

Referring to FIGS. 5*a*, 5*b* and side view FIGS. 6*a* and 6*b*, the upper portion of accessory body 320 forms a v-shape, however, it is not limited to this shape. Earring pin 300 is pushed through the v-shaped upper portion. Beneath the v-shaped upper portion, accessory body 320 maintains an opening 322 where the earring pin 300 enters through. Protrusion 323, where the earring pins locking groove 301 locks into, is within opening 322. Handles 310, for releasing locking groove 301 from protrusion 323 and opening the upper portion of accessory body 320, are positioned on opposite sides of accessory body 320. Spring 330 is fixed within accessory body 320 below opening 322 at point 321. One end of spring 330 rests within the lower portion of accessory body 320 and the other end of spring 330 rests within handle 310.

Hereinafter, the operation of the earring 100 having the construction as described above according to an embodiment of the present invention will be described.

Referring to FIG. 5*a* before handles 310 are pressed together earring pin 300 is locked into opening 322 into protrusion 323 preventing earring pin 300 from sliding forward. Referring to FIG. 5*b*, when handles 310 are pressed together, the upper portions of the accessory body 320 open up and locking groove 301 of earring pin 300 is unlocked from protrusion 323.

Such an arrangement allows for an earring post, such as the present earring pin 300 to be easily pressed through a pierce/opening in the lobe of the ear and then to be clipped into accessory body 320. The upper v-shaped portion provides guides for the smaller pin 300 so that it is easy for the wearer to locate the locking accessory body 320 and guide the pin therein. Pin 300 can likewise be easily unclipped using the large pressing surface of handle 310.

Figure 4A:
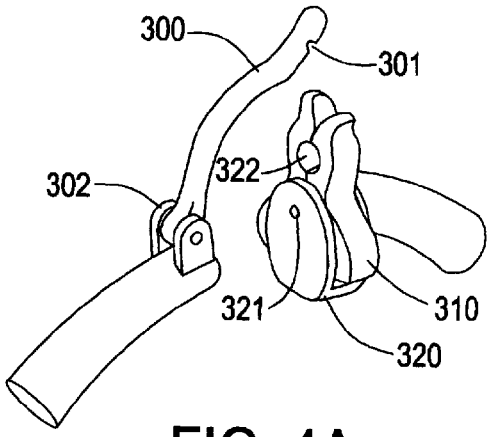
FIGS. 4*a*-4*c* show the earring being inserted into locking body according to another exemplary embodiment of the present invention.
Figure 4B:
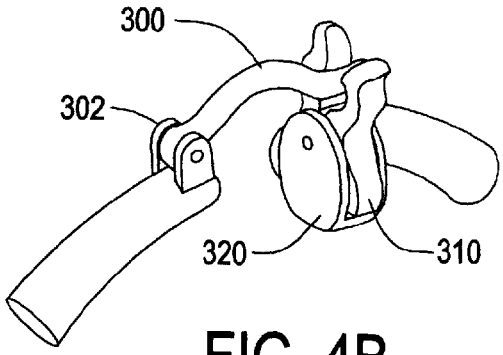
Figure 4C:
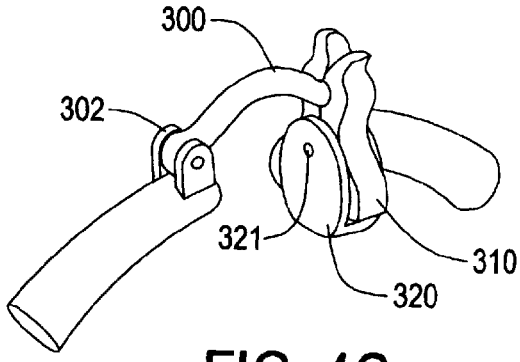

For example referring to FIG. 4, when earring pin 300 is pushed down, the upper portions of accessory body 320 open up with the elastic force of spring 330. When earring pin is pushed down further, locking groove 301 locks into opening 322 in protrusion 323 and results in a secure lock. When handles 310 are pressed open up opening 322 and earring pin 300 is released. At this time, protrusion 323 is separated from the locking groove 301 of earring pin 300, so that the coupling parts 110 and 120 can be unlocked.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

For example, according to the present invention, the earring pin and the structure of the accessory body, which is locked with the earring pin, are described as an example for an earring for the purpose of convenience, however, it can be understood that the locking structure can be also applied to a necklace, a bracelet, etc., in addition to the earring.

The invention claimed is:

1. An earring comprising:

a hoop earring body;

an earring pin rotatably mounted on a first pivot axis at a first end of said hoop earring body, said earring pin having a locking groove;

an accessory body provided at a second end of said hoop earring body, in proximity to and spaced apart from said first end, said accessory body configured to accept said earring pin to secure said first end of said hoop earring body to said second end, closing said hoop earring body, wherein said accessory body has a first handle, a second opposing handle, and a spring, wherein said spring is configured to be mounted on an interior portion of said second handle, with said second handle rotatably mounted within said first handle on a second pivot axis such that said spring is disposed inbetween said handles, said first pivot axis being perpendicular to the second pivot axis, said accessory body being arranged such that said spring at a first end presses against a first inside surface of said first handle and said spring, at a second end, presses against a second inside surface of said second handle;

wherein said accessory body has an opening formed from depressions in said handles when said handles are in a closed position, said closed position and said opening maintained by said spring, said handles each having a flared upper end forming a v-shaped region when said handles are in said closed position, said opening of said accessory body having a protrusion within said opening, said opening dimensioned to receive said earring pin and said locking groove when said earring pin is pressed down through said v-shaped region between said handles, with the protrusion within said opening configured to connect with said locking groove of said earring pin, said spring configured to bias said handles to said closed position to releasably lock said earring pin within said opening;

wherein said handles are configured to be pressed on first and second outside surfaces corresponding to said first and second inside surfaces to release said locking groove of said earring pin from said protrusion within said opening.

2. The earring of claim 1 wherein said earring pin is connected at said first end of said hoop earring body via a hinge.

3. The earring of claim 1 wherein said spring is a tortional spring.

* * * * *